United States Patent [19]

Balzer et al.

[11] 4,276,728

[45] Jul. 7, 1981

[54] DIRT REMOVING GRID SYSTEM FOR FLOORS

[75] Inventors: Claude P. Balzer; Edward M. Corman, both of Wichita, Kans.

[73] Assignee: Balco, Inc., Wichita, Kans.

[21] Appl. No.: 77,290

[22] Filed: Sep. 20, 1979

[51] Int. Cl.[3] ..... E04F 11/16; E04F 19/10; A47L 23/24

[52] U.S. Cl. ..... 52/177; 15/237; 15/238; 52/488; 52/665; 404/36

[58] Field of Search ..... 52/177, 181, 665, 488; 15/238, 237, 37; 404/36

[56] References Cited

U.S. PATENT DOCUMENTS

| | | | |
|---|---|---|---|
| 1,538,907 | 5/1925 | Ritter | 15/237 |
| 2,860,366 | 11/1958 | Kemp | 15/37 X |
| 3,029,452 | 4/1962 | Scott | 15/37 |
| 3,383,822 | 5/1968 | Viehmann et al. | 52/667 |
| 3,685,243 | 8/1972 | Wyss | 52/665 |
| 3,783,471 | 1/1974 | McGeary et al. | 52/181 X |
| 3,808,628 | 5/1974 | Betts | 52/669 X |
| 4,029,834 | 6/1977 | Bartlett | 52/181 X |

FOREIGN PATENT DOCUMENTS

| | | | |
|---|---|---|---|
| 583317 | 9/1959 | Canada | 15/237 |
| 103755 | 4/1964 | Norway | 52/177 |

*Primary Examiner*—Alfred C. Perham
*Attorney, Agent, or Firm*—Fishburn, Gold & Litman

[57] ABSTRACT

A floor grid is provided for a trafficway for removing debris from traffic passing thereover. The grid comprises a support structure below the surface of the trafficway, a plurality of spaced tread rails defining an upper surface which is generally flush with the surface of the trafficway and being supported by the support structure, and a plurality of traverse spacer bars or channels positioned immediately beneath the tread rails. Each tread rail is secured to each spacer channel by a bolt where both cross. Each bolt has a head which is received in and is slidable, when the bolt is not tightened, along a pair of confronting slots in an associated tread rail. Each of the slots has a flat vertical surface which respectively butt against a pair of flat vertical surfaces of the bolt head preventing rotation of the bolt relative to the tread rail. Preferably the slots are just high enough to snugly receive the bolt heads. Feet extend outwardly from the lower end of each tread rail and engage the spacer channels. The feet in conjunction with the tightened bolts resist movement of the tread rail with respect to the spacer channels. The tread rails and spacer channels together form an insert which is easily removable for repair or cleaning. Cushions are provided between the tread rails and support structure to absorb vibration and impact.

12 Claims, 4 Drawing Figures

DIRT REMOVING GRID SYSTEM FOR FLOORS

BACKGROUND OF THE INVENTION

The present invention relates to floor grids having spaced rails for use in entrances of buildings to facilitate removal of debris such as dirt, snow, water, etc., from traffic passing thereover.

Conventional structures for removal of debris from shoes of pedestrians have been unsatisfactory in that one or more of the tread supporting members tends to work loose and becomes dangerous, especially where vehicles which vibrate and shock the grid use the same trafficway. In particular, some of the conventional structures utilize a long key or slide bar which secures together and properly spaces all of the tread supporting members. These keys or slide bars have a tendency to work loose with vibration or wear and to, thus, loosen all of the tread supporting members along the key or bar. The tread supporting members are thereafter wobbly and easily turned which contributes to tripping and falls by the pedestrians and also tends to leave too wide a gap therebetween thus catching the heels of the pedestrians' shoes.

Another prior art structure includes tread support members which have a downwardly opening channel with grooved sides. Threaded bolts anchored in the support structure of the structure engage and tap the grooves. This structure also has a tendency to loosen with time and become dangerous, especially since the bolts are not captured by a complete thread extending entirely around the bolt.

The prior art devices also normally require complete disassembly of the tread support members from the supporting strucure in order to remove any one support member and thus fail to provide for easy removal and replacement of such a support member which is damaged. It is also often difficult to clean beneath conventional devices to remove accumulated debris.

OBJECTS OF THE INVENTION

Therefore, the principal objects of the present invention are: to provide a floor grid for removing debris from traffic crossing thereover; to provide such a grid which allows debris to pass through the grid to an accumulating area therebeneath; to provide such a grid having tread supporting rails which do not tend to loosen from the supporting structure and, if such a rail does loosen at one point, there is no tendency for other rails to simultaneously loosen or for the entire rail to loosen; to provide such a grid wherein each rail is secured by a bolt to each of a plurality of support and spacing bars, wherein the bolts can be individually loosened and tightened; to provide such a grid wherein the head of each of the bolts is snugly received in a pair of confronting slots on an associated tread rail such that the bolt head can slide along the slots so as to be properly spaced therealong and the bolt may be tightened without the head thereof rotating; to provide such a grid having a neat appearance, which is safe to use, is easy to maintain, is capable of an extended useful life, and is particularly well adapted for the proposed usage thereof.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
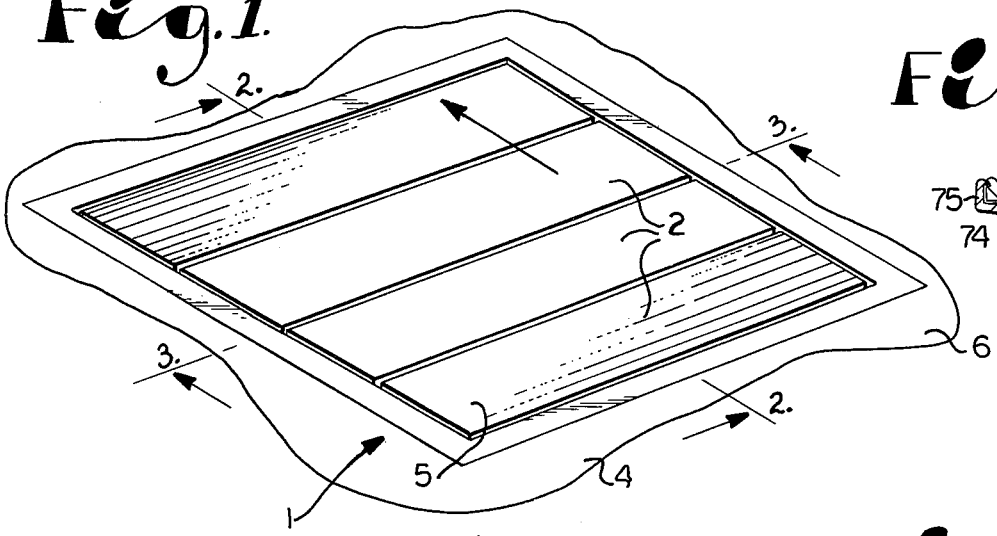
FIG. 1 is a perspective view of a floor grid according to the present invention having tread rails.

As required, detailed embodiments of the present invention are disclosed herein; however, it is to be understood that the disclosed embodiments are merely examplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

As used herein, the terms "top," "bottom," "upper," "lower," "vertical," "horizontal," and various derivatives thereof have the same meaning as shown in the drawings. The term "traverse" means in the direction of the arrows in FIGS. 1 and 2, that is, the left in FIG. 2. The term "transverse" means perpendicular to the arrows in FIGS. 1 and 2.

Figure 2:
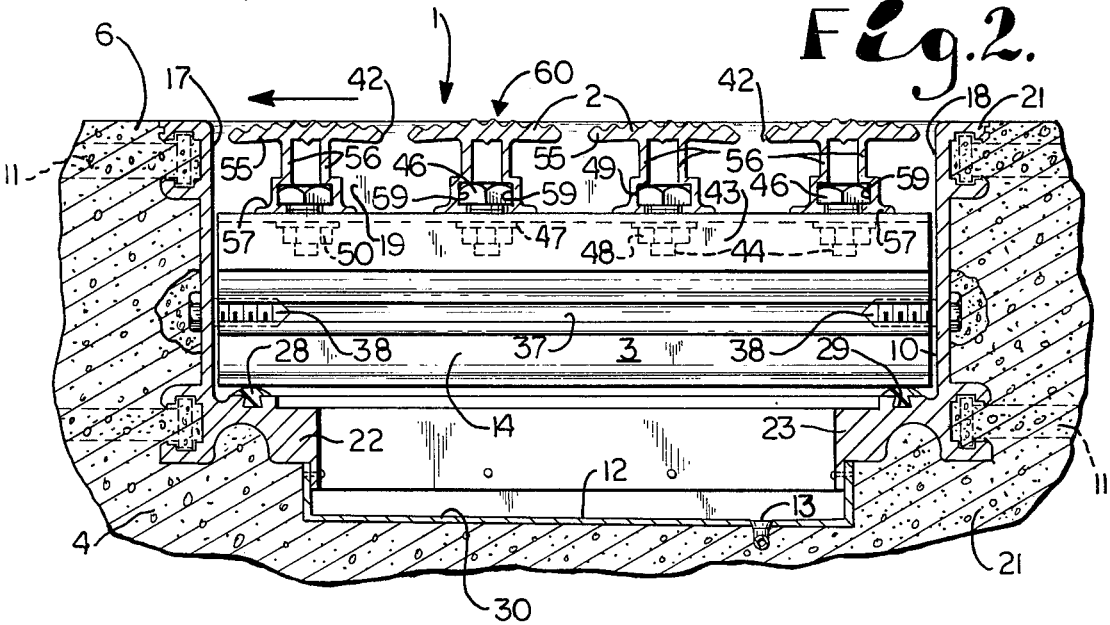
FIG. 2 is a cross-sectional view of the floor grid taken along line 2—2 of FIG. 1, showing a side elevational view of the tread rails.
Figure 3:
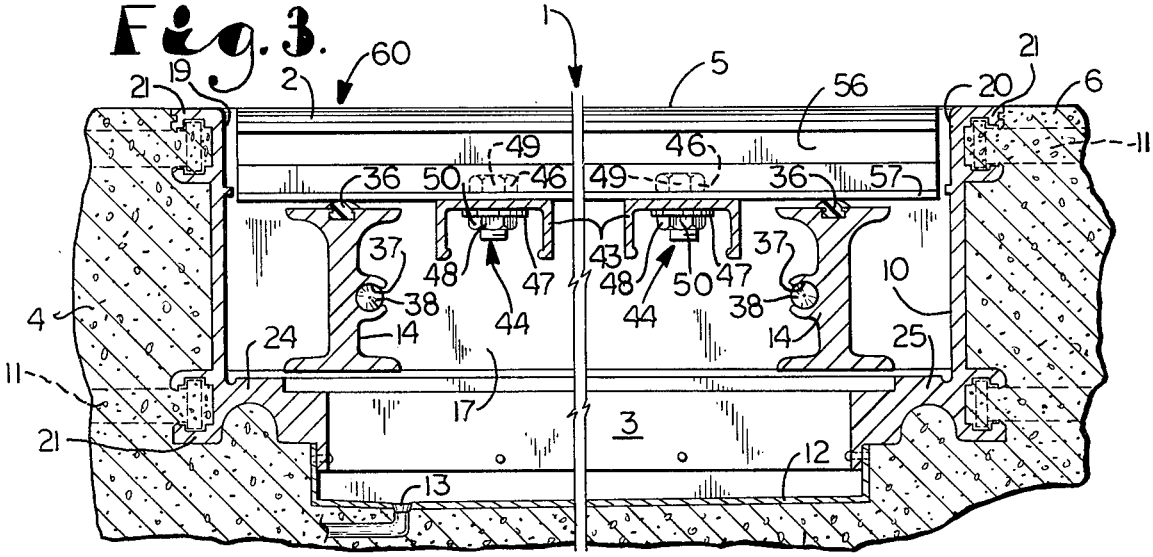
FIG. 3 is a cross-sectional view of the floor grid taken along line 3—3 of FIG. 1.

In FIGS. 1 through 3 the reference numeral 1 generally designates a grate or floor grid having a plurality of spaced tread rails 2 mounted on support means or structure 3. The floor grid 1 is recessed in a surrounding floor 4 such that the top surface 5 of each of the tread rails 2 is substantially flush with an upper surface 6 of the floor 4.

The floor 4 may be any structure for supporting traffic flow, especially pedestrian or a combination of pedestrian and vehicle traffic at an entrance to a building or enclosure. The floor 4 may thus be concrete, as is illustrated, or the like. The floor grid 1 is positioned relative to the floor 4 in such a manner as to be crossed by traffic flow just entering the building from an outside area so that undesirable material or debris such as dirt, mud, water, snow or the like may be removed from the traffic by cooperation between the floor grid 1 and the traffic.

The support structure 3 is utilized to stabilize the grid 1 in a suitable location and provide for accumulation of dirt and water therein. The illustrated support structure 3 comprises a frame 10 anchored in the floor 4 by anchor lugs 11, a collection basin 12 having a drain 13, and a plurality of I-beams or support columns 14 mounted on and attached to the frame 10. The frame 10 has parallel spaced transverse vertical walls 17 and 18 and parallel spaced traverse vertical walls 19 and 20 forming a generally rectangular enclosure. Each of the walls 17, 18, 19 and 20 have receivers 21 therein for holding the anchor lugs 11. Secured to the bottom of and extending inwardly from the transverse walls 17 and 18 are transverse cross members 22 and 23 respectively. Secured to the bottom of and extending inwardly from the traverse walls 19 and 20 are traverse cross members 24 and 25 respectively. The cross members 22, 23, 24 and 25 indirectly support the tread rails 2. The transverse cross members 22 and 23 each have shock absorbing means or a soft cushion 28 and 29 respectively which is connected to and runs longitudinally along the tops thereof. The cushions 28 and 29 may be of pliable vinyl or the like. The basin 12 is basically rectangular and is attached to the lower side of the cross members 22, 23, 24 and 25. A floor 30 of the basin 12 generally slopes toward the drain 13.

The I-beams 14 are parallel, spaced transversely along and supported by the transverse cross members 22 and 23 and are, in particular, positioned such that opposite ends thereof rest on the cushions 28 and 29. Sufficient I-beams 14 are utilized to limit extensive deflection of the tread rails 3 and keep the tread rail top surface 5 substantially flat. A satisfactory spacing of the I-beams 14 is in the nature of one foot with those I-beams 14 nearest the transverse walls 19 and 20 being perhaps one-half foot therefrom. Each of the I-beams 14 have a cushion 36 similar to cushions 28 and 29, attached to and extending longitudinally above the top thereof. Each of the I-beams 14 has a medial channel 37 extending longitudinally therealong. The channels 37 receive lag bolts 38 which penetrate the frame transverse walls 17 and 18 such that the I-beams 14 are secured in position relative to the frame 10.

Although a particular support structure 3 has been described hereinabove, it is foreseen that the structure 3 may be varied substantially within the present invention. For example, the basin 12 could be eliminated or the structure 3 could be shortened thereby eliminating the I-beams 14 should the particular environment of the floor grid 1 require no accumulation area or a shorter grid structure respectively.

The tread rails 2 are substantially parallel and positioned transverse to the normal traffic flow thereacross. Adjacent tread rails 2 have an open slot 42 therebetween. Spacing of the tread rails 2 is close enough to prevent entrapment of the heel of a pedestrian in the open slot 42; however, the slot 42 is sufficiently wide to allow dirt, snow and other small debris to pass through same to the catch basin 12 below. Spacing of the tread rails 2 is maintained by a plurality of spacer bars or, as shown in the illustrated embodiment, channels 43 which are generally parallel to the I-beams 14 and perpendicular to the tread rails 2. Each tread rail 2 is securely attached to each spacer channel 43 whenever both cross by independent locking means or in the illustrated embodiment by a bolt 44. Each bolt 44 includes a head 46, a lock washer 47 and a retaining nut 48. The bolt head 46 and nut 48 are both enlarged members at opposite ends of each bolt 44 and have flat vertical surfaces 49 and 50 respectively thereon, the purpose of which will be described hereinafter. Although the bolt heads 46 are illustrated as engaging the tread rails 2 and the nuts 48 are shown on the underside of the channels 43, it is foreseen that the position of each head 46 and respective nut 48 could be interchanged. The spacer channels 43 open downwardly and are positioned beneath the tread rails 2 alternatively with the I-beams 14. The bolts 44 pass through openings (not shown) in the channels 43 and are retained therein by the enlarged end members, that is, heads 46 and nuts 48. A typical spacing of the channels 43 may be in the nature of one foot with at least two such channels 43 for each floor grid 1.

Each tread rail 2 comprises a horizontal upper tread holding member 55, generally vertical and parallel spaced side walls 56 attached at an upper end thereof to and supporting the tread holding member 55, and a pair of supporting feet 57 attached at a lower end of and extending outwardly from each wall 56. The tread of the present embodiment comprises a serrated rail top surface 60 integral with the tread rail 2 which slopes slightly downward toward the edges thereof. The walls 56 each include a recess on facing sides thereof defining an elongate channel or slot 59. Slots 59 associated with the walls 56 of a single tread rail 2 are parallel and confronting. Associated slots 59 of a single tread rail 2 cooperate to slidably receive the bolt enlarged end member, that is the head 46 or alternatively the nut 48, of untightened bolts 44. When all of the nuts 48 are tightened on respective bolts 44, the rails 2 are securely attached to the spacer channels 43. The feet 57 of each tread rail 2 in cooperation with the tightened bolts 44 associated therewith tend to stabilize the tread rails 2 and prevent them from rocking or shifting relative to the spacer channels 43. Preferably the bolt enlarged end members, that is the heads 46 or alternatively the nuts 48, are snugly received by associated slots 59 such that the enlarged end members engage both the top and bottom surfaces of the slots 59. In addition the flat vertical surfaces on opposite sides of an associated bolt enlarged end member, 49 or 50, respectively butt up against and flatly engage the vertical side wall of the confronting slots 59. Associated slots 59 and flat bolt surfaces 49 engaging the slots 59 together form antirotational means. In this manner each bolt enlarged end member, 46 or alternatively 48, is free to slide along the slots 59 during construction of the grid 1 but is restrained from rotating or vertical movement relative to tread rails 2, while the spacer channels 43 are being secured to the tread rails 2 by tightening the bolts 44.

In construction, the support structure 3 of the floor grid 1 is normally positioned in and secured to the floor 4 during construction of the latter with the I-beams 14 in place relative to the frame 10. Preferably the parts of the floor grid 1 are of a strong but light material such as extruded aluminum members. The tread rails 2 and spacer channel 43 are secured together in a criss-cross configuration by the bolts 44 in the manner described hereinabove. It is noted that the butting of the flat surfaces of the bolt heads against associated slot walls prevents rotation of the former during tightening of the bolts 44; the butting also provides additional support to the tread rails 2 during use. The tread rails 2 and spacer channels 43 together define a removable insert 60 which is snugly positioned in the recess provided therefor on support structure 3 such that the top surface 5 is substantially flush with the floor 4. The insert 60 rests on the cushions 36. The cushions 36 in conjunction with the cushions 24 and 25 reduce wear on the floor grid 1 by absorbing impact, shock and vibration between the insert 60 and the support structure 3. The frame walls 17, 18, 19 and 20 prevent substantial horizontal movement of the insert 60, thus providing a generally tight horizontal mounting thereof, while gravity urges the insert 60 to remain in place on the support structure 3. The insert 60 is easily raised to provide for cleaning of the basin 12 or for repair thereof.

For repair of a single tread rail 2, the entire insert 60 does not have to be disassembled; rather, only those bolts 44 associated with that particular rail 2 need be loosened, the old rail removed by sliding along the bolts 44 and a new rail replaced and secured to the insert 60.

In use, the floor grid 1 is positioned where a heavy pedestrian traffic flow occurs from which it is desired to remove debris such as dirt or snow from the feet thereof. By walking across the grid 1 or by scraping the bottoms of the feet thereon, the traffic dislodges debris which falls between the tread rails 2 through the slots 42 into the basin 12. The grid 1 is generally resilient in nature and comfortable to the feet of pedestrian traffic crossing thereover.

The basin 12 is periodically cleared or flushed to remove accumulated debris. Water is removed from the basin 12 by drain 13. It is noted that if one of the bolts 44 should be damaged or loosened, that an entire tread rail or group of tread rails 2 is not simultaneously loosened, thereby remaining generally safe to walk upon until repair of a damaged bolt can be accomplished.

Figure 4:
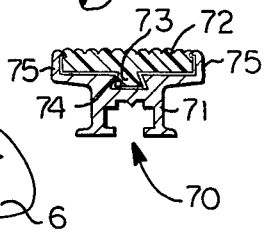
FIG. 4 is a cross-sectional view of a modified tread rail shown in the same position as the tread rails of FIG. 2.

FIG. 4 illustrates an alternative tread rail 70 which is utilized essentially as the tread rail 2 of the previous embodiment. The tread rail 70 is somewhat shorter than the tread rail 2 and includes a body portion 71 and a grooved tread 72 having a depending projection 73 which enlarges toward the bottom thereof and which slidably mates with an associated slot 74 on the tread rail body portion 70. It also has vertical extensions 75 from the upper outer edges thereof which function to hold the tread 72 in place on the body portion 71.

It is foreseen that other tread material such as carpet or abrasive strips could be utilized with the tread rail 70 of FIG. 4.

It is to be understood that while certain embodiments of the present invention have been illustrated and described herein, it is not to be limited to the specific forms or arrangement of parts described and shown.

Having thus described the invention, what is claimed and desired to secure by Letters Patent is:

1. A floor grid for use in trafficways for removing debris from traffic passing thereover, said grid comprising:

(a) support means below a surface of and connected to said trafficway;

(b) a plurality of parallel spaced transverse tread rails supported by said support means and having an upper tread surface generally flush with said trafficway surface and a base; said tread rails allowing the debris deposited thereon to pass therebetween;

(c) a plurality of parallel traverse spacer bars each having a top and positioned immediately beneath said tread rails, said tread rails crossing said spacer bars at a plurality of locations; and (d) locking means positioned at each said location for independently securing together said tread rails and said spacer bars and for urging said bases against said tops of said spacer bars.

2. The floor grid according to claim 1 wherein:

(a) each of said locking means comprises a bolt having enlarged members at opposite ends thereof; a first one of said enlarged members engaging a respective tread rail and the opposite enlarged member engaging a respective spacer bar whereby tightening said bolt urges said base of said respective tread rail against said top of said respective spacer bar; and (b) antirotational means on said first enlarged member to prevent rotating of said bolt relative to said respective tread rail when tightening same.

3. The floor grid according to claim 2 wherein:

(a) said respective tread rail includes a pair of confronting parallel slots for slidably receiving said bolt first enlarged member; said slots each having a flat vertical wall portion; and (b) said bolt first enlarged member has at least one flat vertical surface thereon which butts against said flat wall portion of one of said slots; said antirotational means comprising the engagement of said first enlarged member surface and an associated and cooperating slot wall portion;

(c) whereby said bolt first enlarged member will slide along associated slots when said bolt is not tightened, and said first enlarged member will not rotate relative to said respective tread rail while said bolt is being tightened; and (d) each of said bolts can be individually tightened and loosened whereby said tread rails and said spacer bars are independently secured together at respective said locations.

4. The floor grid according to claim 3 wherein:

(a) said bolt first enlarged member has a second flat vertical surface thereon which butts against said flat wall portion of the other of said slots opposite said one slot; whereby said slot flat wall portions and said first enlarged member flat vertical surfaces cooperate to prevent rotation of said bolt first enlarged member.

5. The floor grid according to claim 4 wherein:

(a) said bolt first enlarged member is a head of said bolt having a generally constant height;

(b) each of said slots of each tread rail having a height substantially equivalent to the height of said head; whereby said slots securely capture said head and prevent substantial rotational or vertical movement of said head relative to said tread rail and each of said bolts can be individually tightened and loosened by rotating said second enlarged member with respect to said first enlarged member.

6. The floor grid according to claim 2 wherein:

(a) said respective tread rail base includes a pair of feet extending outwardly therefrom and engaging said respective spacer bar with which the respective tread rail is secured together; and (b) said feet in cooperation with said bolt prevent substantial movement of the respective tread rail with respect to said respective spacer bar when said base of said respective tread rail is urged against said top of said respective spacer bar.

7. The floor grid according to claim 1 wherein:

(a) said tread rails and said spacer bars define a unitary insert which insert is held on said support means by gravity and is easily removable for cleaning or repair.

8. The floor grid according to claim 1 wherein:

(a) shock absorbing means are positioned between said support means and said tread rails; whereby vibration transmitted to said tread rails by traffic is not substantially transmitted to said support means, thereby reducing wear on said support means and making crossing of said grid more comfortable to traffic.

9. The floor grid according to claim 1 which includes:

(a) each adjacent pair of said parallel spaced transverse tread rails defining an open slot therebetween, each said open slot being continuous along substantially the entire transverse length of said floor grid for allowing debris deposited on said tread rails to fall therethrough.

10. A floor grid for use in trafficways for removing debris from traffic passing thereover, said grid comprising:

(a) support means below a surface of and connected to said trafficway;

(b) a plurality of parallel spaced transverse tread rails supported by said support means and allowing the debris deposited thereon to pass therebetween, each said tread rail including:

(1) an upper tread having a surface generally flush with said trafficway;

(2) an upper tread holding member connected to said upper tread;

(3) a pair of opposed side walls below said upper tread holding member, said side walls being in spaced relationship and supporting and abutting said upper tread holding member; and (4) a base positioned beneath and connected to said side walls;

(c) a plurality of parallel traverse spacer bars each having a top and positioned immediately beneath said tread rails, said tread rails crossing said spacer bars at a plurality of locations; and (d) locking means positioned at each said location for independently securing together said tread rails and said spacer bars and for urging said bases of said tread rails against said tops of said spacer bars.

11.

the floor grid according to claim 10 wherein: (a) each side wall includes an inwardly facing slot having a flat vertical wall portion;

(b) each of said locking means comprises a bolt including:

(1) a first enlarged member at one end of said bolt having a flat vertical surface thereon which butts against said flat vertical wall portion of one of said side wall slots of a respective said tread rail; and (2) a second enlarged member at an opposite end of said bolt engaging a respective said spacer bar;

(c) said one side wall slot slidably receives said bolt first enlarged member when said bolt is not tightened;

(d) said bolt flat vertical surface butts against said flat vertical wall portion of said one side wall slot whereby said first enlarged member is prevented from rotating when said bolt is tightened; and (e) each of said bolts can be individually tightened whereby said bolt urges said base of said respective tread rail against said top of said respective spacer bar.

12. The floor grid according to claim 11 wherein:

(a) said base of said respective tread rail includes a pair of opposed flanges extending inwardly from said side walls with said bolt first enlarged member positioned over said flanges and a portion of said bolt extending therebetween, each of said flanges defining a lower part of a respective side wall slot;

(b) said base of said respective tread rail includes a pair of feet extending outwardly from said side walls, and engaging said respective spacer bar with which the respective tread rail is secured together; and (c) said flanges and said feet in cooperation with said bolt prevent substantial movement of said respective tread rail with respect to said respective spacer bar when said base of said respective tread rail is urged against said top of said respective spacer bar.

* * * * *